United States Patent [19]

Schnyder et al.

[11] 3,951,485

[45] Apr. 20, 1976

[54] DISPENSER FOR TEXTILE HAND TOWELLING WEB

[75] Inventors: Conrad W. Schnyder, Triesenberg, Liechtenstein; Gunter Kullik, Beerfelder, Falken-Gesass, Germany

[73] Assignee: Conrad W. Schnyder, Triesenberg, Liechtenstein

[22] Filed: Jan. 31, 1975

[21] Appl. No.: 545,783

[30] Foreign Application Priority Data

Feb. 6, 1974 Switzerland ..... 1606/74

[52] U.S. Cl. ..... 312/38; 242/55.53; 312/39

[51] Int. Cl.[2] ..... B65H 19/00

[58] Field of Search ..... 312/38, 39; 242/53.5

[56] References Cited

UNITED STATES PATENTS

| | | | |
|---|---|---|---|
| 3,826,548 | 7/1974 | Schnyder | 312/38 |
| 3,858,951 | 1/1975 | Rasmussen | 312/38 |

*Primary Examiner*—Casmir A. Nunberg

[57] ABSTRACT

A dispenser for textile hand towelling web is disclosed in which towelling is dispensed over a rotatable dispensing roller which is blocked each time after the dispensation of a predetermined length of fresh hand towelling. The dispenser also comprises an arrangement operable by an electric motor for drawing used hand towelling in. In a dispenser of this kind a measuring and control arrangement is provided for each time preventing release of the blocked dispensing roller at least until a predetermined minimum length of used hand towelling, corresponding to a major part of the length previously dispensed over the dispensing roller and possibly also by the drawing-in arrangement, has been drawn in. The said measuring and control arrangement may include, in engagement with the used towelling which is drawn in, a roller for measuring the length of drawn-in towelling, for example by counting each time the number of rotations of this roller. The dispensing roller may remain blocked, after said minimum length of used hand towelling has been drawn in, until the towelling is tensioned over the housing between the dispensing roller and the drawing-in arrangement.

9 Claims, 6 Drawing Figures

| step | 1 | 2 | 3 | 4 | 5 | 6 | 7 | 8 | 9 | 10 | 11 | 12 | 1 |
|---|---|---|---|---|---|---|---|---|---|---|---|---|---|
| position | 0° | 30° | 60° | 90° | 120° | 150° | 180° | 210° | 240° | 270° | 300° | 330° | 360° |
| switch 2 | ■ | | | | | | | | | | | | ■ |
| " 3 | | ■ | | | ■ | | | | | | | | |
| " 6 | | ■ | | | | | | | | | | | |
| " 7 | | | | | ■ | | | | | | | | |
| " 4 | | | ■ | ■ | | | | | | | | | |
| " 5 | | | ■ | ■ | | | | ■ | ■ | ■ | ■ | | |
| " 1 | | | | | | ■ | ■ | | | | | ■ | |
| " 9 | | | | | | | | ■ | ■ | ■ | ■ | ■ | |
| " 10 | | | | | | | | | | | | ■ | |
| " 8 | | ■ | ■ | ■ | ■ | ■ | ■ | ■ | ■ | ■ | ■ | ■ | |

DISPENSER FOR TEXTILE HAND TOWELLING WEB

BACKGROUND OF THE INVENTION

This invention relates to a textile hand towelling web dispenser with a housing for accommodating a supply of fresh hand towelling, which towelling can be dispensed from the housing over a rotatable dispensing roller which can be blocked each time a predetermined length of fresh hand towelling has been dispensed, and comprising an arrangement operable by an electric motor for drawing used hand towelling into the housing.

Such textile hand towelling web dispensers are known as a rule are so constructed that the hand towelling is held taut over the lower side of the housing when in a rest position ready for operation. Fresh hand towelling therefore has to be dispensed before each use, this being desirable for hygienic reasons. (Prior hand towelling dispensers, in which a loop of hand towelling always hangs out of the housing, are less desirable hygienically). After use, and usually automatically after expiry of a predetermined use period, the arrangement operable by the electric motor is brought in to retract the used hand towelling into the housing and thus bring the dispenser back to the ready rest position. This is achieved as soon as the electric motor is switched off again, this for example being performed through a switch which responds when the indrawn towelling is tensioned. It is only that fresh hand towelling can be dispensed again via the dispensing roller.

It is a conceivable hazard that hand towelling web dispensers of this kind may be misused, in that the aforesaid switch is caused to respond if the hand towelling is gripped and held during the retracting operation whereby the dispenser can be caused to dispense repeated lengths of hand towelling as often as is wanted.

The object of the present invention is to make textile hand towelling web dispensers of the kind set forth above proof against misuse.

SUMMARY OF THE INVENTION

To meet the said object the textile hand towelling web dispenser of the present invention is characterised by a measuring and control arrangement which each time prevents release of the dispensing roller at least until a predetermined minimum length of used hand towelling has been drawn in.

The aforesaid minimum length can of course advantageously be so determined as to correspond to a major part of the length of the hand towelling which is dispensed each time for use.

The control arrangement can also prohibit the release somewhat longer, namely after the retraction of the minimum length until the hand towelling is under tension, and this for example can be determined by a detector switch or torque limiting device.

The retraction may for example be performed by a retracting roller driven by the electric motor and the rotations of this retracting roller may be counted, or its angular position measured, to meter the length of hand towelling drawn in.

Advantageously an electric motor can also be used for driving the dispensing roller and this coupled to the dispensing roller for example through a worm and worm gear, so that the dispensing roller can be blocked or released by simple switching off or switching on of the electric motor.

BRIEF DESCRIPTION OF THE DRAWINGS

Various embodiments of the textile web hand towelling dispenser according to the invention are illustrated in the accompanying drawings. In these drawings.

DETAILED DESCRIPTION OF PREFERRED EMBODIMENTS

Figure 1:
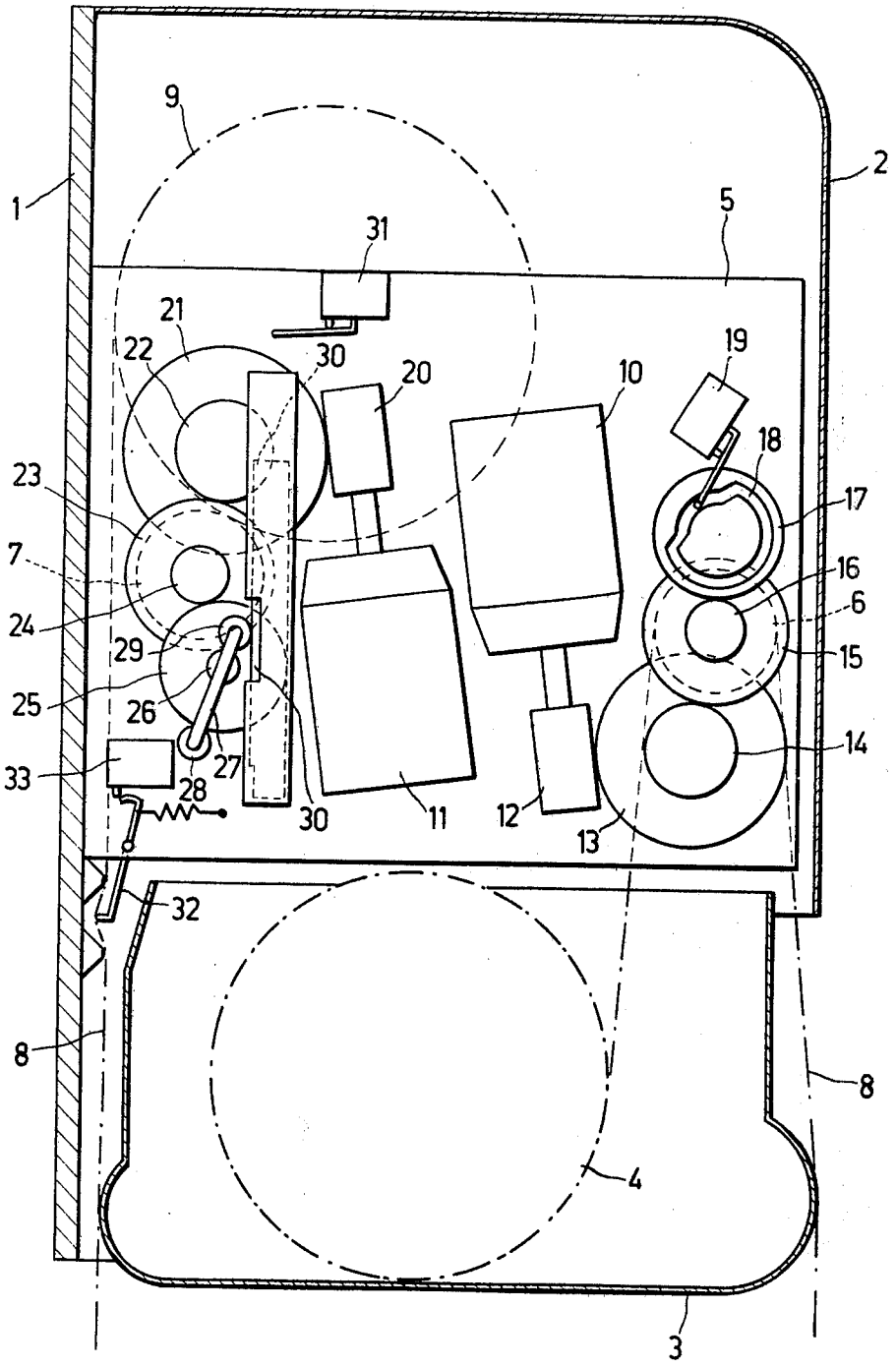
FIG. 1 is a diagrammatic side view of a dispenser for a web of hand towelling, with the side wall of the housing omitted.

The textile hand towelling web dispenser shown in FIG. 1 comprises a housing with a rear wall 1, which may for example be secured to a wall of a toilet, a housing upper part 2 and a dished lower housing part 3 which accommodates a supply of fresh hand towelling in the form of a reel 4. Secured to the rear wall 1 are two lateral mounting plates 5, one of which is seen in FIG. 1. A rotatable dispensing roller 6 and a rotatable retracting roller 7 are arranged between these mounting plates. A web form hand towelling is dispensed from the reel 4 of fresh hand towelling out of the housing over the dispensing roller 6. The path of the hand towelling is indicated by a chain dotted line 8. A reel 9 of used hand towelling is disposed on the retracting roller 7, and this is movable by the roller 7 to draw used hand towelling into the housing and wind it up.

Electric motors 10 and 11 are used respectively for driving the dispensing roller 6 and the retracting roller 7, and these motors are secured to the mounting plate 5. Motor 10 drives the dispensing roller 6 through a worm 12 on the motor shaft, a worm wheel 13, a pinion 14 and a toothed wheel 15 mounted on the shaft of the dispensing roller 6. A pinion 16 also mounted on this shaft meshes with a toothed wheel 17 having a control cam 18 which, after a rotation, operates a switch 19 in order to cut out the motor 10 again. The motor is started by a user operating a switching device, for example a press button, a light responsive unit, a proximity switch of the like (not shown). At the same time the motor 11 is also switched on to drive the retracting roller 7 in the unwinding direction, that is to say so that used hand towelling is unwound from the reel 9 and delivered rearwards from the housing.

Motor 11 drives the retracting roller 7 through a worm 20 mount on the motor shaft, a worm wheel 21, a pinion 22 and a toothed wheel 23 mounted on the shaft of the retracting roller 7. A pinion 24 also mounted on this shaft meshes with a toothed wheel 25. The cutting out of motor 11 after the unwinding and dispensing of a length of used hand towelling can be initiated from the switch 19 or by a switch (not shown) which is operated by the toothed wheel 25 after about one rotation (depending on the starting position).

Toothed wheel 25 carries a pinion 26. In addition an arm 27 is mounted for pivoting about the axis of toothed wheel 25. The pivot arm 27 carries a rotatable pinion 28 which engages the toothed wheel 25, and a pinion 29 which meshes with the pinion 26. When the retracting roller 7 turns in the clockwise direction (in relation to FIG. 1) to wind off used hand towelling from the reel 9 and to dispense it, pivot arm 27 is turned in the counterclockwise direction by pinion 28 to release the pinion 29 from a vertically displaceable rack 30. When, in contrast, hand towelling is drawn in the pivot arm 27 turns in the clockwise direction and brings pinion 29 into engagement with rack 30. Pinion 29 then carries rack 30 upwards from the lower rest position illustrated in the drawing and after a predetermined minimum length of used hand towelling has been drawn in and wound up rack 30 operates a switch 31. The aforesaid minimum length of hand towelling corresponds approximately to the total length of hand towelling which has previously been dispensed over the dispensing roller 6 and over the retracting roller 7. For example the dispensing roller 6 performs about 2.5 rotations during dispensing and the retracting roller 7 performs about two rotations during its dispensing (in the clockwise direction), and the arrangements may then be such that during the retracting and winding up of used hand towelling the switch 31 is operated after four rotations of the retracting roller 7 (in the counterclockwise direction) or after about two rotations of the toothed wheel 25.

Applied to the used hand towelling passing to the reel 9 is a pivotable spring-urged hand towelling braking flap 32. When the hand towelling is tensioned it turns the flap 32 against its spring bias in the counterclockwise direction (as related to FIG. 1). An arm connected to the flap operates a switch 33 to stop the retracting motor 11.

The operation of the hand towelling web dispenser according to FIG. 1 is as follows:

In the rest position standing ready for operation the hand towelling used by a previous user is wound up on reel 9; hand towelling 8 is tautened over the underside of the housing between dispensing roller 6 and reel 9. Rack 30 is in its upper end position closing switch 31. This switch is disposed in the circuit of the switching arrangement (press button, light responsive unit, proximity switch or the like) referred to above, but not shown in the drawings, and this arrangement is consequently activated.

To implement a delivery of hand towelling a following user operates the switching arrangement which brings in motor 10 and at the same time motor 11 to operate in the unwinding direction. The first result is for the pinion 29 to be released from rack 30, wherefore this latter drops and opens the switch 31 to render fresh operation of the switching arrangement impossible (until subsequently the minimum length of hand towelling has been wound up again).

Motors 10 and 11 when switched on drive rollers 6 and 7 to dispense hand towelling from the reels 4 and 9 from the housing at the front and rear. After predetermined lengths of hand towelling have been dispensed the motors are stopped. A loop of hand towelling now hangs from the housing for a predetermined period of time to enable the user to dry his hands.

After expiry of the predetermined period the retracting motor 11 is automatically switched on to operate in the wind-up direction to draw used hand towelling into the housing and reel it up. At this time the rack 30 is moved upwards from its bottom rest position.

If for any reason the hand towelling becomes tautened, for example because it is held tight by a user, the switch 33 will temporarily switch off the motor 11, thus preventing overload. However, a further operation of the switching arrangement to produce a dispensing of hand towelling is, as previously mentioned, only made possible when the predetermined minimum length of used hand towelling has been drawn in and the rack 30 has operated switch 31. When the held hand towelling is released, switch 33 brings the motor 11 in again in order to finish the winding up of hand towelling until this towelling, eventually tautened over the lower side of the housing, operates switch 33 again.

The activation of the switching arrangement could be made dependent on both switch 31 and switch 33 being operated, a fresh switching on only therefore being permitted when the predetermined minimum length of hand towelling has been wound up and the hand towelling tautened thereafter.

The measurement of a predetermined minimum length of wound up used hand towelling could also of course be determined by means other than the rack 30.

Figure 2:
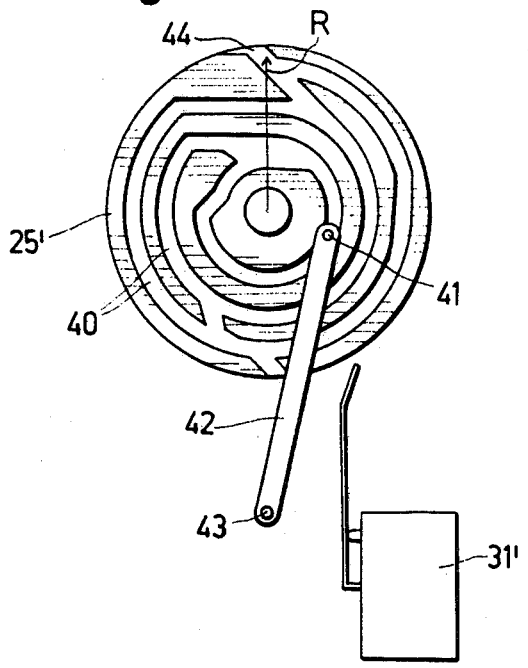
FIGS. 2 and 3 are side views similar to that of FIG. 1 showing parts in each case of a modification.

For example FIG. 2 shows a control disc 25' provided with spiral groove sections 40, which disc could be mounted on the toothed wheel 25. A pin 41 mounted on an arm pivotal about axis 43 engages in these grooves 40. The arm 42 is urged by springs (not shown) to the illustrated position in which the pin 41 is engaged in the groove section of the second smallest radius. During the dispensing of hand towelling from reel 9, when the disc 25 turns in the counterclockwise direction, the pin 41 will be moved in the groove sections 40 inwards towards the center of the disc; it reaches the innermost groove track after ½ to 1½ rotations of the disc if it has started in contact with the outermost peripheral part of the disc. During the drawing in of used hand towelling and when the disc 25' turns in the clockwise direction the pin 41 is moved outwardly by the groove sections 40 and reaches the start of the groove at 44 after about 2 to 2⅞ rotations, depending on the initial positioning of disc 25'. When pin 41 has been impelled outwardly to the point indicated by radius R, arm 42 operates a switch 31' which has the same function as the switch 31 in FIG. 1. Fresh operation of the hand towelling dispenser is thus only possible each time after a length of used hand towelling corresponding to at least two rotations of the disc 25 have been drawn in. It is obvious that the groove sections 40 might also be arranged so as to carry pin 41 and switch operating arm 42 outwards during the dispensing of towelling from reel 9, and inwards during the drawing in. In both cases the angle of rotation corresponding to the minimum length of wound up used hand towelling is the angle necessary for conducting pin 41 from a first (inner or outer) radial end position to a second (outer or inner, respectively) radial end position.

Figure 3:
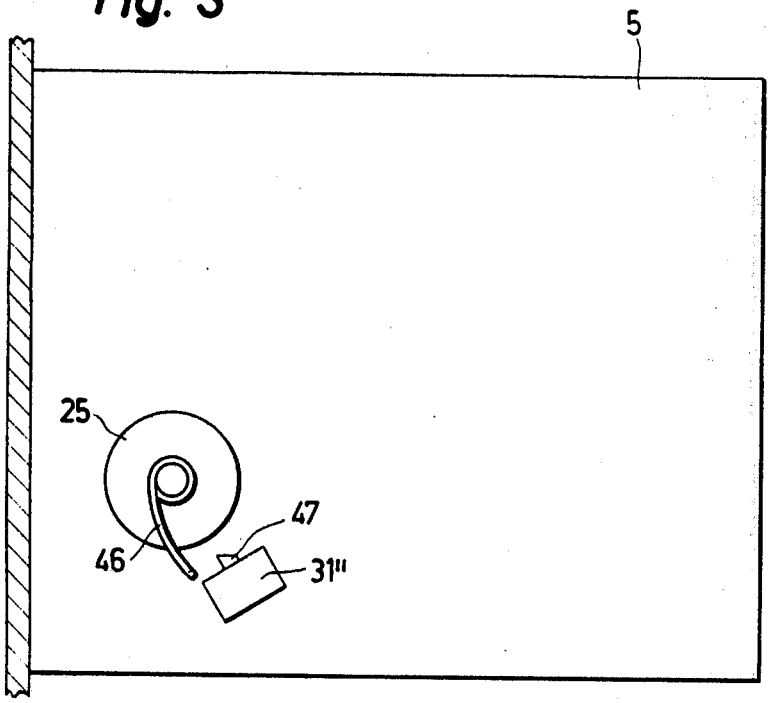

FIG. 3 illustrates a further possibility. A helical spring having an extended arm 46 is mounted on the shaft of the pinion 25 and cooperates with a switch 31'' which has the same function as the switch 31 in FIG. 1. In the embodiment illustrated by FIG. 3 the transmission ratio between the retracting roller 7 and toothed wheel 25 is advantageously chosen different from the ratio in FIG. 1, and in particular so that the toothed whell performs about ⅓ to ½ of a turn (in the counterclockwise direction) during the dispensing of used hand towelling. The arm 46 of the helical spring, starting approximately from the position illustrated, after about 1/10 of a rotation strikes the underside of the bevelled switch operating member 47 (without operating the switch); the spring then remains stationary whilst the toothed wheel 25 can turn further in the counterclockwise direction. The spring is wound on the shaft of the pinion 25 in such direction that thereafter, when during the winding up of the used hand towelling the toothed wheel 25 turns in the clockwise direction, the spring 46 is positively entrained and, after somewhat less than one rotation, operates switch 31''. Switch 31'' thus prevents switching on of the electric motor 10 again (FIG. 1), and thereby prohibits release of dispensing roller 6, until a length of used hand towelling corresponding to almost one rotation of the toothed wheel 25 (about four rotations of the retracting roller 7) has been drawn in.

Figure 4:
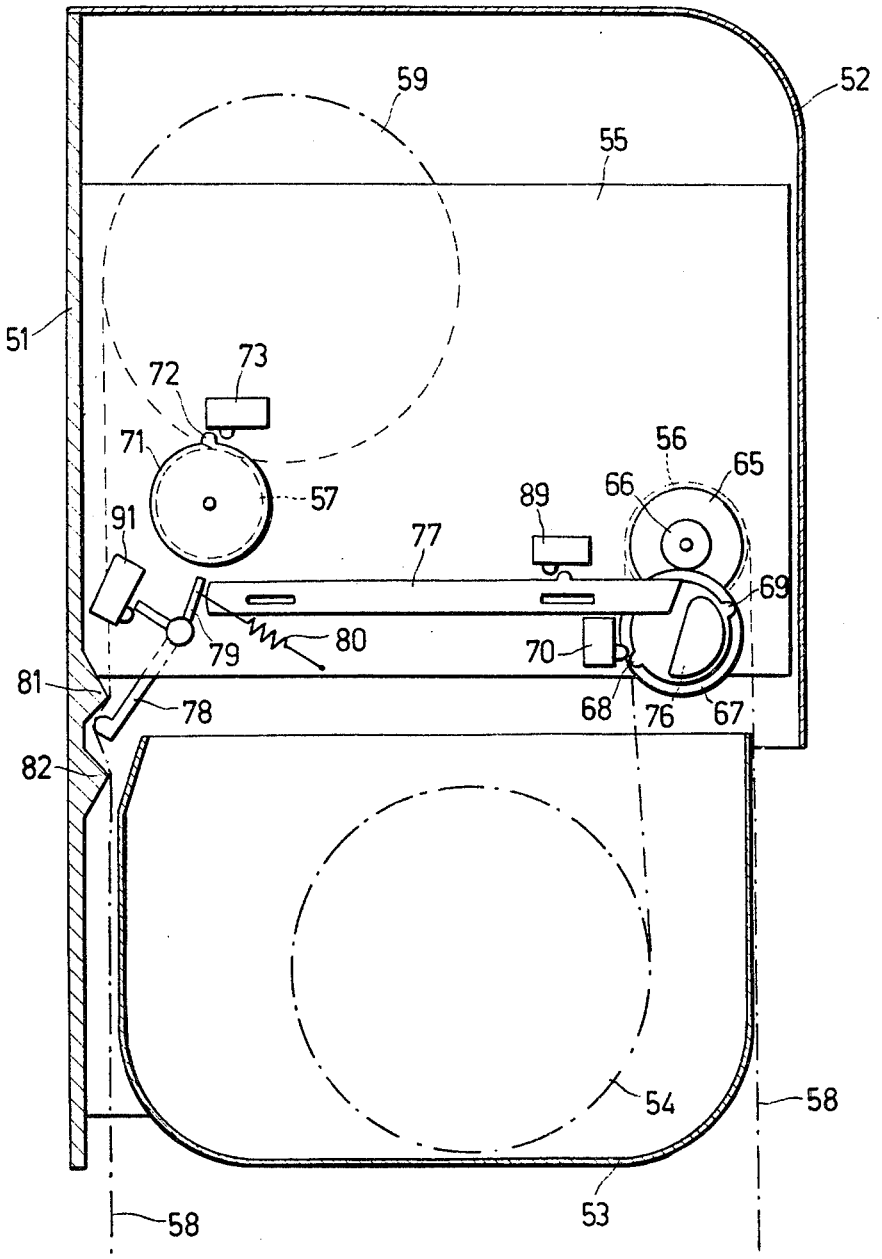
FIG. 4 is a view similar to that of FIG. 1 of another form of hand towelling web dispenser.
Figures 5, 6:
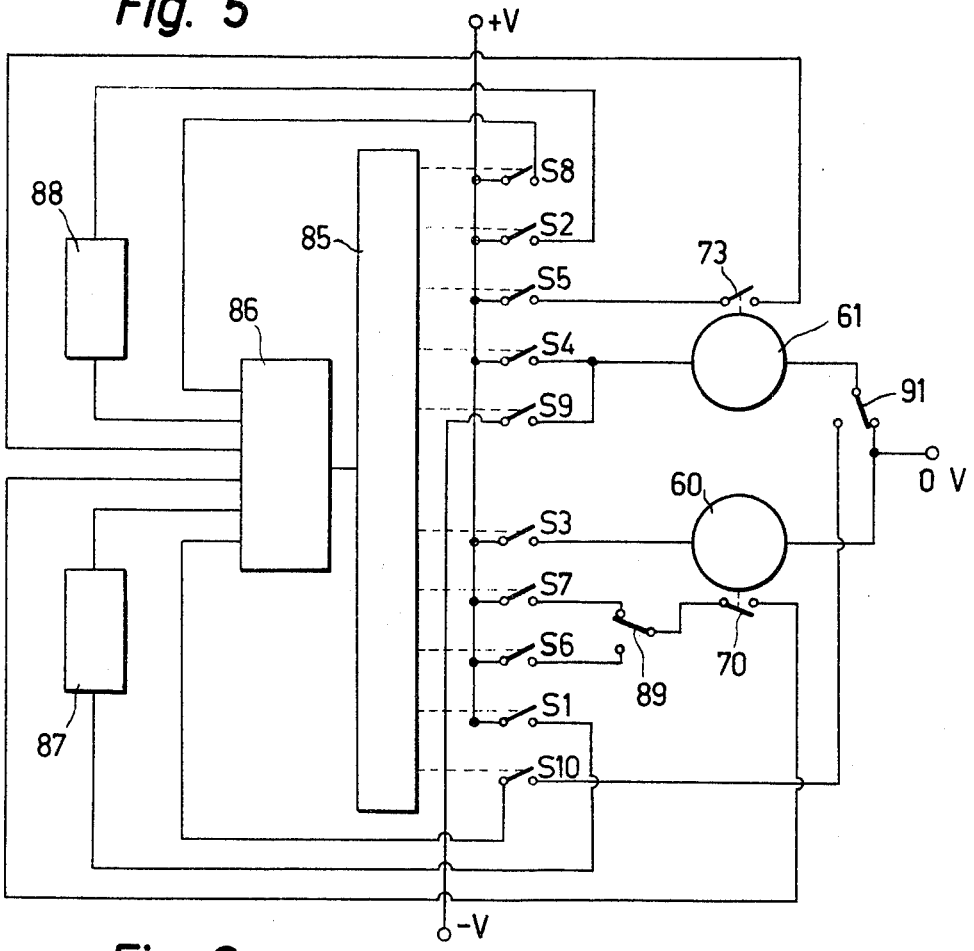
FIG. 5 is a circuit diagram of a control arrangement for the dispenser according to FIG. 4 and, FIG. 6 is a cam switching plan of a stepping switch of the arrangement illustrated in FIG. 5.

FIGS. 4 to 6 illustrate another embodiment of the hand towelling web dispenser according to the invention. As shown in FIG. 4 the dispenser has a housing with a rear wall 51 which, for example, can be secured to a wall of a toilet, a housing upper part 52 and a dished housing lower part 53 which accommodates a supply of fresh hand towelling in the form of a reel 54.

Attached to the rear wall 51 are two lateral mounting plates 55, one of which is shown in the drawing, and a rotatable dispensing roller 56 and a rotatable retracting roller 57 are arranged between these. The hand towelling of web form can be dispensed out of the housing from the reel 54 of fresh hand towelling over the dispensing roller 56. The path of the towelling is indicated by the chain dotted line 58. Roller 56 can be driven by an electric motor 60, which has been omitted from FIG. 4 and has only been diagrammatically depicted in FIG. 5, over a wormwheel 65.

A reel 59 of used hand towelling is disposed on and in contact with the retracting roller 57 and can be driven by the latter to draw used hand towelling into a housing and wind it up. An electric motor 61, which again has been omitted from FIG. 4 and only diagrammatically illustrated in FIG. 5, is used to drive a retracting roller 57 through a wormwheel 71. Wormwheel 71 has a dog 72 which cooperates with a switch 73 (see also FIG. 5) and operates this once every revolution of the retracting roller 57. A programming wheel 67 is coupled with the wormwheel 65 of the dispensing roller 56 through a pinion giving a transmission ratio of 1:2.5 this wheel 67 having two dogs 68 and 69 which cooperate with a switch 70 (see also FIG. 5). In addition the programming wheel 67 carries an eccentric cam 76 which cooperates with the leading end of a thrust rod 77 which is mounted for horizontal displacement on the mounting plate 55. The rear end of rod 77 acts on an arm 79 mounted on the pivot shaft of a hand towelling braking flap 78. This flap 78 presses the hand towelling passing to the reel 59, under the action of tension spring 80 engaging arm 79, between two projections 81 and 82 form the rear wall 51 of the housing to smooth and tension the hand towelling.

The hand towelling dispenser according to FIG. 4 has a control arrangement as diagrammatically illustrated in FIG. 5. This arrangement comprises ten control switches S1 to S10 which are operated by a rotatable cam-provided drum 85. This cam drum has twelve different angular positions spaced by 30° in each case and can be turned into these successive positions by a stepping motor 86. FIG. 6 shows which of the switches S1 to S10 are closed by their cams in the different angular positions of drum 85. The stepping motor can be switched on through various circuits one of which contains a delay device 87 and another a manually operable switch device 88. Apart from the switches 70 and 73 already mentioned the control device also contains a switch 89 which is operated by a dog on the thrust rod 77 (FIG. 4) when this is pushed rearwards by cam 76, and a switch 91 which is operated by an arm connected to the braking flap 78 when this arm is pushed out between the projections 81 and 82 by stiffly tensioned hand towelling and against the action of spring 80.

The operation of the hand towelling web dispenser in accordance with FIGS. 4 and 5 is as follows:

In a rest position, standing ready for operation, the hand towelling used by a previous user is wound up on the reel 59; the hand towelling 58 is drawn taut over the underside of the housing between the dispensing roller 56 and the reel 59. Cam drum 85 is in the position 0° (FIG. 6); only switch S2 of switches S1 to S10 is closed, and positive tension is applied to the switching device 88.

This switching device 88 is for example a light responsive unit, a proximity or contact switch, a press button or the like and it is operated by a subsequent user manually (or by sheer proximity), to initiate the dispensing of hand towelling. When operated the switching device starts the stepping motor 86 and this turns the cam drum 85 into position 30°.

In this position of cam drum 85 switches S3 and S6 are closed. A positive tension is applied to the dispensing motor 60 through switch S3. Motor 60 turns the dispensing roller 56 in the delivery direction to draw off fresh hand towelling from reel 54 and dispense it from the housing. At the same time programming wheel 67 is turned at the reduced ratio of 2.5:1 so that cam 76 pushes thrust rod 77 rearwards. As a result the hand towelling braking flap 78 is released from the hand towelling lying on projections 81 and 82, against the action of spring 80. Thrust rod 77 also operates the switch 89 to connect the switch 70 to the closed switch S6. Switch 70 in turn is closed by dog 69 and switches on stepping motor 86 as soon as the programming wheel has been turned through about one-half of a revolution and thus the dispensing roller 56 through about 1.25 revolutions. The stepping motor 86 turns cam drum 85 into position 60°. In this 60° position the switches S4 and S5 are closed. Positive tension is applied to motor 61 through switch S4 so that it turns the retracing roller 57 in the unreeling direction to dispense used hand towelling from reel 59. The dispensing of used hand towelling can be performed without difficulty thanks to the fact that the braking flap 78 has previously been released from the towelling. After a maximum of one rotation of the retracting roller 57 dog 72 actuates the switch 73 and this, supplied through switch S5, imparts a forward switching signal to the stepping motor 86. Switches S4 and S5 are closed again in position 90° of cam drum 85 and the same procedure is repeated as in position 60°, that is to say used hand towelling is again dispensed and to a length corresponding to one rotation of the retracting roller, and then the cam drum 85 is indexed again through motor 86.

Switches S3 and S7 are closed in position 120° of the cam drum. The dispensing motor 60 is given a positive tension through switch S3 so that it turns the dispensing roller 56 to dispense more fresh hand towelling. At the same time the programming wheel 67 is further turned and the cam 76 released from thrust rod 77 and the braking flap 78 returned to the starting position illustrated in the drawing. Also at the same time the switch 89 is released and returns to the illustrated position in which it connects the closed switch S7 with switch 70. As a result the latter imparts a switch-on signal to motor 86 as soon as it is operated by dog 68 after one-half of a rotation of the programming wheel 67. In position 150° of the cam drum 85 only a signal to the delay device 87 is given through switch S1. This starts a predetermined period during which a user can dry his hands on a loop of hand towelling which is hanging from the housing. This loop is made up of a length of used hand towelling reeled off reel 59 corresponding to two or somewhat less rotations of the retracting roller 57, and a predetermined length of fresh hand towelling corresponding to 2.5 rotations of the dispensing roller 56. After the first one-half of this predetermined user period has elapsed the delay device 87 gives a signal to the stepping motor 86 and this turns the cam drum 85 into its 180° position.

In position 180° switch S1 again gives a signal to the delay device 87 and the second one-half of the user period now elapses, after which there is a switching-on to 210°.

In position 210° of the cam drum 85 switches S5 and S9 are closed: The closure of switch S9 applies a negative tension to retracting motor 61 so that this turns the retracting roller 57 in the retracting direction (wind-up direction) to reel up the used hand towelling on reel 59. After one rotation of the retracting roller 57 dog 72 operates switch 73, supplied through closed switch S5, to send a switch-on signal to the stepping motor 85.

In positions 240°, 270° and 300° of the cam drum switches S5 and S9 are closed as in position 210° and further used hand towelling is drawn in and wound up in each position by an amount corresponding to one rotation of the retracting roller 57. The braking flap 78 is at the time in the active position illustrated in the drawing and smooths and tensions the hand towelling running to the reel 59. When, during the drawing in of the hand towelling, this becomes taut between the projections 81 and 82, for example because it is held taut by a user, the braking flap 78 will then operate switch 91 to temporarily interrupt the circuit of motor 61 until the tension in the hand towelling is relieved.

In position 330° of the cam drum 85 switches S1, S9 and S10 are brought into operation. Switch S9 causes the retracting motor 61 to remain operative and wind up hand towelling. After about one-half a revolution of the retracting roller 57, that is to say when this has made a total of about 4½ rotations and thus drawn in all the previously dispensed hand towelling and wound it up, the towelling is again tensioned over the lower side of the housing and flap 78 operates switch 91. This switch interrupts the current of the motor and at the same time through closed switch S10 sends an advancing signal to stepping motor 86. This turns the cam drum 85 into position 360° or 0°, so that the dispenser is once again in the rest position ready for operation. It is only at this time that the switching device 88 is activated again through switch S2 and can be operated once more.

So long as the retracting roller 57, during the retracting operation, has not completed four rotations and thereby moved the cam drum 85 from position 210° into positions 240°, 270°, 300° and 330°, the 360° position cannot be reached, the switch S2 therefore cannot be closed and the switching device not activated. This prevents the dispensing motor 60 being switched on until a predetermined minimum length of used hand towelling (corresponding to four rotations of the retracting roller 57, and about 8/9 of the length of hand towelling which have previously been dispensed), has been drawn in and until thereafter the switch 91 operated by the tensioned hand towelling has given an indexing signal through switch S10. When the motor 60 is cut off the dispensing roller 56 is blocked because it is connected to the motor through a worm gear.

When the supply 54 of hand towelling has been used up and the end of this towelling is hanging out of the housing for final use, the whole of the remainder of the hand towelling can thereafter be wound up on the reel 59; this because the hand towelling is no longer tensioned and switch 91 is not operated in position 330° of cam drum 85 so that the retracting motor 61 simply continues to turn. When this happens the retracting motor is stopped after the lapse of a predetermined period by the delay device 87 which sends to the stepping motor 86 the signal, which is received from switch S1 in position 330°, to bring about the turning on to position 360°.

Switch S8, which has not hitherto been mentioned, is closed in all positions of cam roller 85 except the 0° position. It has the function in conjunction with a cover switch (not shown), when the dispenser is opened, to move the cam drum on to the 0° position independently of the prevailing phase of the programme.

What we claim is:

1. A dispenser for textile hand towelling web comprising:

a housing for accommodating a supply of fresh hand towelling, a rotatable dispensing roller for dispensing towelling from said supply out of said housing, means for blocking said dispensing roller each time a predetermined length of fresh hand towelling has been dispensed, an arrangement operable by an electric motor for drawing used hand towelling into said housing, and a measuring and control arrangement including means for each time preventing release of said dispensing roller at least until a predetermined minimum length of used hand towelling has been drawn in, said minimum length being equal to at least about (8/9 ) of the length of towelling dispensed in each operation.

2. A dispenser as claimed in claim 1, further comprising a switch responsive to tension in the indrawn hand towelling for switching off said electric motor, and wherein said measuring and control arrangement includes means for prohibiting release of said dispensing roller, after said minimum length of thand towelling has been drawn in, until a subsequent response from said switch.

3. A dispenser as claimed in claim 1, further comprising a motor-driven driving arrangement for operating said dispensing roller, means for automatically blocking said dispensing roller when said driving arrangement is switched off, and a switching device operable by a user for bringing said driving arrangement into operation, and wherein said measuring and control arrangement includes means for determining a predetermined minimum angle of rotation of a roller which contacts the indrawn hand towelling, and a switch operable by said last-mentioned means to activate said switching arrangement which is insensitive without such activation.

4. A dispenser as claimed in claim 3, wherein said means for determining said minimum angle of rotation include a pinion coupled to said roller which contacts the indrawn hand towelling, and a device for coupling said pinion to a rack when said roller turns in a retracting direction, said rack being movable by said pinion from a rest position into an active position in which it operates said switch.

5. A dispenser as claimed in claim 3, wherein said means for determining said minimum angle of rotation include a control disc coupled to said roller which contacts the indrawn hand towelling, said control disc being provided with sections of spiral grooves, and a switch operating member engaging in said groove sections for being conducted progressively from a first to a second radial end positions during rotation of said roller in a retracting direction, said member operating said switch when said control disc has turned at least through a predetermined angle.

6. A dispenser as claimed in claim 3, wherein said means for determining said minimum angle of rotation include a shaft coupled to said roller which contacts the indrawn hand towelling, and a helical spring having an extended arm and which is wound on said shaft in such manner that said arm is carried to an abutment when said roller turns in a dispensing direction, whereupon said spring releases said shaft, and that said arm is positively entrained by said shaft during rotation in a retracting direction for operating said switch after a predetermined angle of rotation.

7. A dispenser as claimed in claim 3, wherein said means for determining said minimum angle of rotation include a dog coupled to said roller which contacts the indrawn hand towelling, a switch which is operable by said dog at each revolution, and means for counting the number of operations of said switch operable by said dog.

8. A dispenser as claimed in claim 3, further comprising a control device adapted upon operation of said switching device to cause dispensation of said predetermined length of fresh hand towelling by said dispensing roller, to cause dispensation of a length of used hand towelling previously drawn in by means of said drawing-in arrangement, to leave the dispensed length of hand towelling at the disposal of a user for a predetermined period, and then to cause drawing-in of the used hand towelling by means of said drawing-in arrangement, said predetermined minimum length of hand towelling being equal to a major part of the sum of the previously dispensed lengths of hand towelling.

9. A dispenser as claimed in claim 8, wherein said control device is a programmed sequence control device which can reach the end of its programme each time only after said predetermined minimum length of used hand towelling has been drawn-in.

* * * * *